US009650111B2

(12) United States Patent
Yuck et al.

(10) Patent No.: US 9,650,111 B2
(45) Date of Patent: May 16, 2017

(54) MOORING SYSTEM AND DRILL SHIP INCLUDING THE SAME

(71) Applicant: SAMSUNG HEAVY IND. CO., LTD., Seoul (KR)

(72) Inventors: Rae-Hyoung Yuck, Daejeon (KR); Yong-Ho Choi, Daejeon (KR); Dong-Woo Jung, Daejeon (KR)

(73) Assignee: Samsung Heavy Ind. Co., Ltd., Seoul (KR)

( * ) Notice: Subject to any disclaimer, the term of this patent is extended or adjusted under 35 U.S.C. 154(b) by 0 days.

(21) Appl. No.: 14/896,630

(22) PCT Filed: Jun. 16, 2014

(86) PCT No.: PCT/KR2014/005240
§ 371 (c)(1),
(2) Date: Dec. 7, 2015

(87) PCT Pub. No.: WO2014/204145
PCT Pub. Date: Dec. 24, 2014

(65) Prior Publication Data

US 2016/0137268 A1 May 19, 2016

(30) Foreign Application Priority Data

Jun. 21, 2013 (KR) ..... 10-2013-0071394

(51) Int. Cl.
*B63B 21/50* (2006.01)
*B63B 3/14* (2006.01)
*B63B 35/44* (2006.01)

(52) U.S. Cl.
CPC ..... *B63B 21/507* (2013.01); *B63B 3/14* (2013.01); *B63B 21/50* (2013.01); *B63B 35/44* (2013.01); *B63B 2003/147* (2013.01)

(58) Field of Classification Search
CPC ..... B63B 22/00; B63B 22/02; B63B 22/18; B63B 21/00; B63B 21/50; B63B 21/507; B63B 35/44; B63B 3/14
(Continued)

(56) References Cited

U.S. PATENT DOCUMENTS 3,481,294 A * 12/1969 Vincent ..... E21B 7/12 114/230.12
4,698,038 A * 10/1987 Key ..... B63B 21/507 441/5

(Continued)

FOREIGN PATENT DOCUMENTS

| | | |
|---|---|---|
| KR | 10-2008-0109418 | 12/2008 |
| KR | 10-0943457 | 2/2010 |
| WO | 03/039946 | 5/2003 |

OTHER PUBLICATIONS

International Search Report for PCT/KR2014/005240 mailed on Jul. 7, 2014 and its English translation from WIPO.

(Continued)

*Primary Examiner* — Lars A Olson
(74) *Attorney, Agent, or Firm* — Ladas & Parry, LLP

(57) ABSTRACT

Disclosed are a mooring system and a drill ship including the same. The mooring system according to an embodiment of the present invention includes a circular guide groove formed on a bottom surface of a hull and configured to use a center of the moon pool as a center thereof, a turret having a ring shape and inserted into the guide groove to rotate, and a bearing interposed between the turret and the guide groove to rotate with respect to the guide groove of the turret.

2 Claims, 8 Drawing Sheets

(58) Field of Classification Search
USPC ..... 114/230.12, 230.13, 230.15; 441/3, 4, 5
See application file for complete search history.

(56) References Cited

U.S. PATENT DOCUMENTS

| | | | | | |
|---|---|---|---|---|---|
| 5,311,091 | A | | 5/1994 | Maudal | |
| 5,746,148 | A | * | 5/1998 | Delago | B63B 21/507 114/230.12 |
| 5,823,131 | A | * | 10/1998 | Boatman | B63B 21/508 114/230.12 |
| 5,823,837 | A | | 10/1998 | Boatman et al. | |
| 5,860,382 | A | * | 1/1999 | Hobdy | B63B 21/507 114/230.15 |
| 5,893,334 | A | | 4/1999 | Poranski, Sr. | |
| 6,199,500 | B1 | * | 3/2001 | Borseth | B63B 21/507 114/230.12 |
| 8,950,349 | B2 | * | 2/2015 | Lindblade | B63B 21/507 114/230.12 |

OTHER PUBLICATIONS

Notice of Allowance dated Jun. 12, 2015 for Korean Patent Appl. No. 10-2013-0071394 and its English summary provided by Applicant's foreign counsel.
Office Action dated Dec. 5, 2014 for Korean Patent Appl. No. 10-2013-0071394.
Office Action dated Jun. 2, 2014 for Korean Patent Appl. No. 10-2013-0071394.
Extended European Search Report dated Jan. 3, 2017 for European Patent Application No. 14813844.9.

* cited by examiner

MOORING SYSTEM AND DRILL SHIP INCLUDING THE SAME

CROSS-REFERENCE TO RELATED APPLICATIONS

This application is the U.S. National Stage of International Patent Application No. PCT/KR2014/005240 filed on Jun. 16, 2014, which claims priority to Korean Patent Application No. 10-2013-0071394 filed on Jun. 21, 2013, the disclosures of which are hereby incorporated in their entiretites by reference.

TECHNICAL FIELD

The present invention relates to a mooring system and a drill ship including the same.

BACKGROUND ART

Recently, there is a move to actively drill and explore the Arctic Ocean in which a large amount of crude oil is buried. However, when fixed-type crude oil and natural gas drill equipment is installed in a polar region, such as the Arctic Ocean, there is a problem in that the fixed-type drill apparatus is damaged due to collision with an ice floe or a support unit of the fixed-type drill equipment buckles due to an increase in ice load caused by freezing seawater in a winter season. Therefore, it is not desirable to use the fixed-type drill apparatus in the polar region.

Also, since it is uneconomical to install the fixed-type drill apparatus in a small-scale offshore oil well that has a small amount of crude oil to be mined from one borehole, use of a floating drill equipment, such a as drill ship equipped with a drill apparatus, has significantly increased.

However, the drill ship is floating equipment, and as such it is hard for the drill ship to remain at rest at a certain position due to an environmental load caused by wind, waves, and tidal currents. Therefore, a mooring system is used so that the drill ship stays within a predetermined range during drilling for crude oil or gas.

Typically, the mooring system includes a plurality of mooring cables. The plurality of mooring cables have one end parts installed at various parts of the drill ship, respectively, and are arranged to be radially spread. The plurality of mooring cables have the other end parts to which anchors fixed to the seabed are installed, respectively.

However, when the environmental load is applied to the drill ship, weathervaning in that a prow part is directed toward a direction of the environmental load is generated. Since the drill ship is fixed by the mooring cables, an influence by the environmental load is continuously applied to the drill ship. That is, when the drill ship is shaken, fatigue corrosion of the drill ship and the like caused by the environmental load is generated. When the fatigue corrosion is generated, transgranula corrosion breaking gradually proceeds, thereby a service life of the drill ship is reduced.

DISCLOSURE

Technical Problem

An embodiment of the present invention provides a mooring system capable of handling environmental loads, and a drill ship including the same, and also provides a mooring system that is not limited to a shape of a moon pool, and a ship including the same.

Technical Solution

One aspect of the present invention provides a mooring system of a drill ship having a moon pool formed in a hull, the mooring system may include a circular guide groove formed on a bottom surface of the hull and configured to use a center of the moon pool as a center thereof, a turret having a ring shape and inserted into the guide groove to rotate, and a bearing interposed between the turret and the guide groove to rotate with respect to the guide groove of the turret.

The turret may have a I-shaped cross-section to include an upper horizontal unit, a lower horizontal unit, and a vertical connecting unit mutually connecting the upper horizontal unit with the lower horizontal unit, and the bearing may include a first bearing configured to support the upper horizontal unit in a lateral direction, a second bearing configured to support the upper horizontal unit in a gravitational direction, and a third bearing configured to support the lower horizontal unit in a buoyancy direction.

The guide groove may include a support unit protruding from a side surface thereof, the lower surface of the upper horizontal unit may be arranged to face an upper surface of the support unit, and the second bearing may be interposed between the upper horizontal unit and the support unit.

The upper horizontal unit and the vertical connecting unit may be integrally manufactured, and the lower horizontal unit may be coupled to the vertical connecting unit.

The turret may include a turret body and an extension member extended from the turret body in a side direction, and the bearing includes a first bearing pad configured to support an upper surface and a lower surface of the extension member, and a second bearing pad configured to support a side surface of the extension member.

One aspect of the present invention provides a drill ship including the above-described mooring system.

Advantageous Effects

According to an embodiment of the present invention, a circular guide groove, using a center of a moon pool as a center, is formed on a bottom surface of a hull, and a turret is rotated in the guide groove, and thus the drill ship is moored to efficiently correspond to an environmental load.

Since the guide groove is formed to surround a bottom inlet of the moon pool, the moon pool may have various cross-sectional shapes regardless of the shape of the guide groove.

MODES OF THE INVENTION

Figure 1:
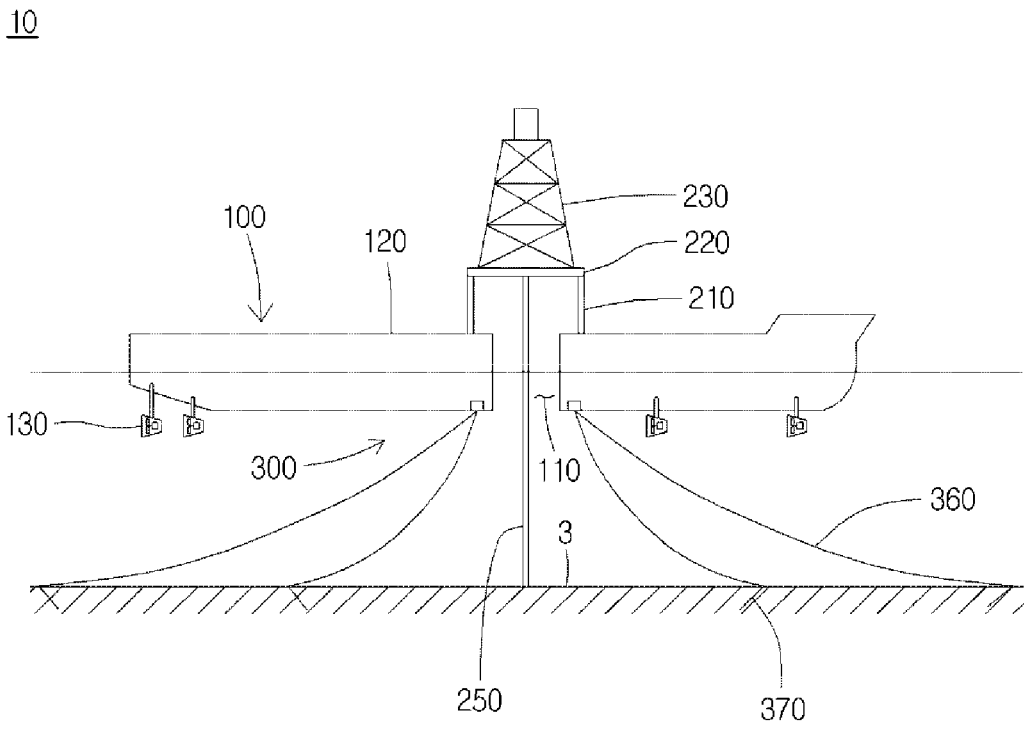
FIG. 1 is a side view of a drill ship according to an embodiment of the present invention.

As embodiments allows for various changes and numerous embodiments, exemplary embodiments will be illustrated in the drawings and described in detail in the written description. However, this is not intended to limit embodiments to particular modes of practice, and it is to be appreciated that all changes, equivalents, and substitutes that do not depart from the spirit and technical scope of embodiments are encompassed in embodiments. In the description of embodiments, certain detailed explanations of the related art are omitted when it is deemed that they may unnecessarily obscure the essence of the inventive concept.

Hereinafter, embodiments of the present invention will be described with reference to the accompanying drawings, but the same or like reference numerals designate the same components and overlapping descriptions thereof will be omitted.

Figure 2:
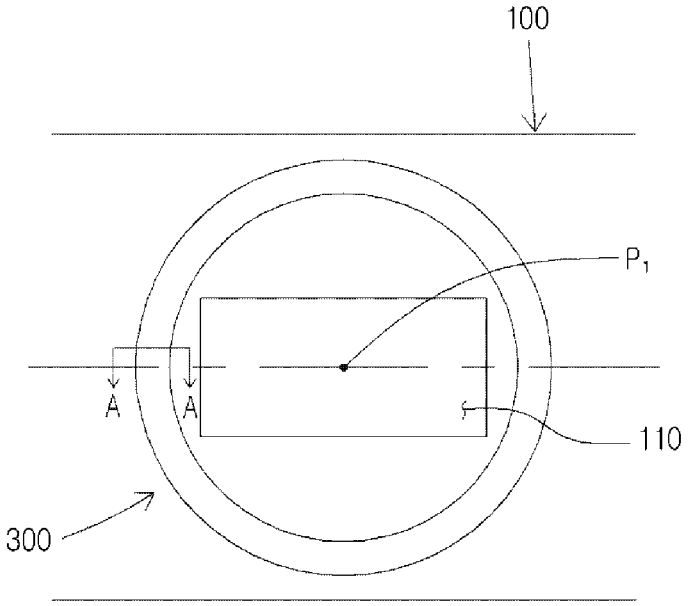
FIG. 2 is a bottom view of the drill ship according to the embodiment of the present invention.
Figure 3:
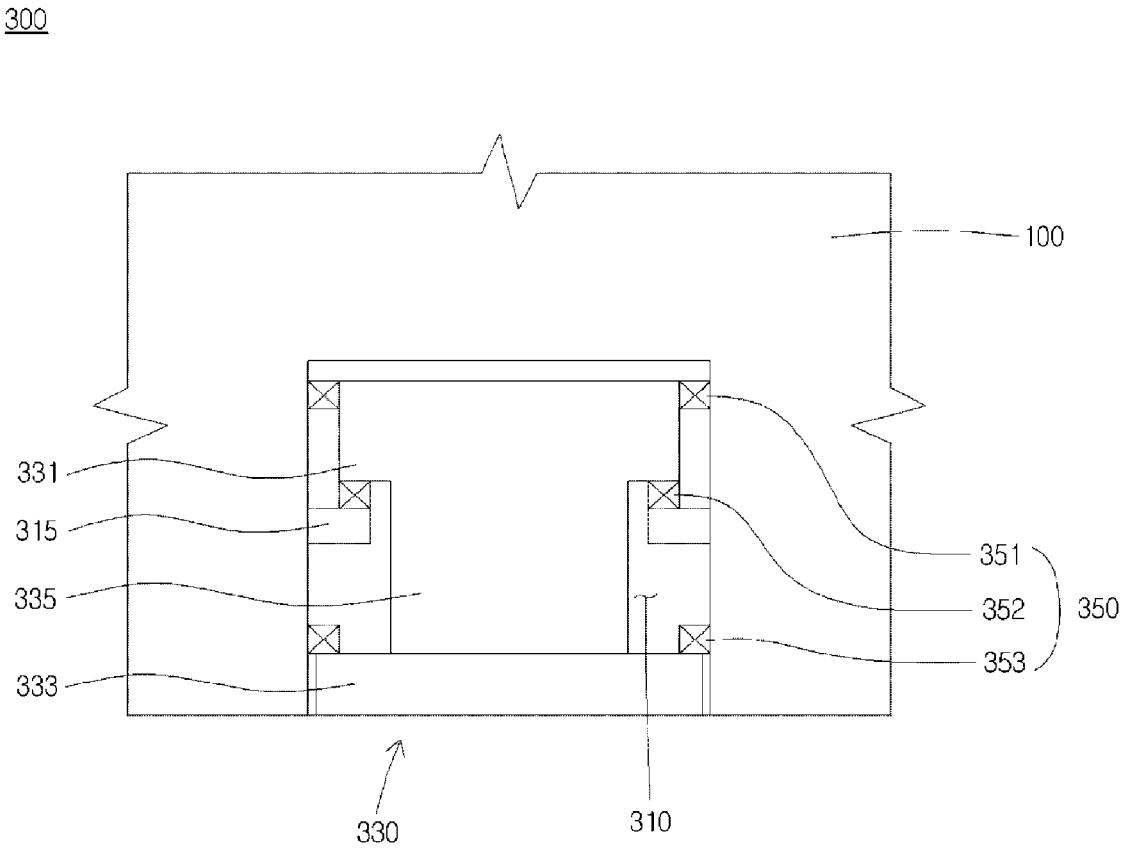
FIG. 3 is an upside down view of a cross-section of A-A of FIG. 2.

FIG. 1 is a side view of a drill ship according to an embodiment of the present invention, FIG. 2 is a bottom view of the drill ship according to the embodiment of the present invention, and FIG. 3 is an upside down view of a cross-section of A-A of FIG. 2. Referring to FIGS. 1 to 3, a drill ship 10 according to the embodiment of the present invention includes a hull 100 and a mooring system 300.

The hull 100 includes a moon pool 110 extended in a vertical direction. A support 210 is installed in an upper deck 120 of the hull 100, a drill floor 220 on which a worker performs drilling is installed on the support 210. A derrick 230 is installed on the drill floor 220.

A riser 250 is extended from the drill floor 220 toward a seabed 3 during drilling. The riser 250 is connected with an ocean floor through the moon pool 110. The riser 250 may be arranged to pass through a center P1 of the moon pool 110.

An azimuth thruster 130 is installed on a lower surface of the hull 100 and is used for dynamic positioning control of the drill ship 10.

The mooring system 300 includes a guide groove 310, a turret 330, a bearing 350, mooring cables 360, and anchors 370.

The guide groove 310 is formed on a bottom surface of the hull 100. The guide groove 310 has a circular shape using the center P1 of the moon pool 110 as a center. The guide groove 310 is formed to surround a bottom inlet of the moon pool 110. The moon pool 110 may have various cross-sections regardless of a shape of the guide groove 310.

The turret 330 is inserted into the guide groove 310. The turret 330 has a ring shape. The turret 330 is inserted into the guide groove 310 and rotates. The bearing 350 is interposed between the turret 330 and the guide groove 310. The bearing 350 is provided to allow for relative rotation with respect to the guide groove 310 of the turret 330.

One end part of the mooring cable 360 is coupled to the turret 330. A plurality of mooring cables 360 may be coupled to the turret 330, and the plurality of mooring cable 360 are coupled at regular intervals in a circumferential direction of the turret 330. The plurality of mooring cables 360 are spread toward the seabed 3 in a radial direction. The anchors 370 fixed to the seabed 3 are installed at the other parts of the mooring cables 360.

When the environmental load is applied to the drill ship 10, weathervaning in which a prow part is directed toward a direction of the environmental load is generated. In this case, the hull 100 is rotated about the center P1 of the moon pool 110, the turret 330 remains at an original position by relative rotation with respect to the hull 100 by tension of the mooring cable 360. Therefore, the mooring system 300 may effectively correspond to the environmental load.

According to the embodiment, the turret 330 has a I-shaped cross-section to include an upper horizontal unit 331, a lower horizontal unit 333, and a vertical connecting unit 335 mutually connecting the upper horizontal unit 331 and the lower horizontal unit 333.

The upper horizontal unit 331 and the vertical connecting unit 335 are integrally manufactured. In this case, the lower horizontal unit 333 is coupled to the vertical connecting unit 335. For example, the lower horizontal unit 333 is bolted and coupled to the vertical connecting unit 335.

According to the present invention, the bearing 350 includes a first bearing 351, a second bearing 352, and a third bearing 353.

The first bearing 351 supports the upper horizontal unit 331 in a lateral direction. The first bearing 351 is interposed between a side surface of the upper horizontal unit 331 and a side surface of the guide groove 310. When the turret 330 rotates in the guide groove 310, the first bearing 351 prevents the turret 330 from escaping from the guide groove 310 in the lateral direction.

The second bearing 352 supports the upper horizontal unit 331 in a gravitational direction. A support unit 315 protrudes from a side of the guide groove 310. A lower surface of the upper horizontal unit 331 and an upper surface of the support unit 315 are arranged to face each other, and the second bearing 352 is interposed between the upper horizontal unit 331 and the support unit 315. The second bearing 352 prevents the turret 330 from escaping from the guide groove 310 by a dead load.

The third bearing 353 supports the lower horizontal unit 3 in a buoyancy direction. Buoyancy opposite to the gravitational direction is applied to the turret 330 positioned under water. Buoyancy applied to the turret 330 disturbs rotation of the turret 330 by closely attaching an upper surface of the turret 330 to a ceiling surface of the guide groove 310. The third bearing 353 supports the lower horizontal unit 333 in the buoyancy direction to prevent the turret 330 from being closely attached to the ceiling surface of the guide groove 310 by the buoyancy. The third bearing 353 supports an upper surface of the lower horizontal unit 333.

When a combination of the turret 330 and the bearing 350 is used, the turret 330 may rotate in the guide groove 310, and separation of the turret 330 in the lateral direction, escaping of the turret 330 due to the dead load, and adhesion of the turret 330 due to the buoyancy may be efficiently prevented.

FIGS. 4 to 7 are views illustrating an installation method of a turret device according to the embodiment of the present invention. Hereafter, referring to FIGS. 4 to 7, the installation method of the turret 330 according to the embodiment of the present invention will be described.

Figure 4:
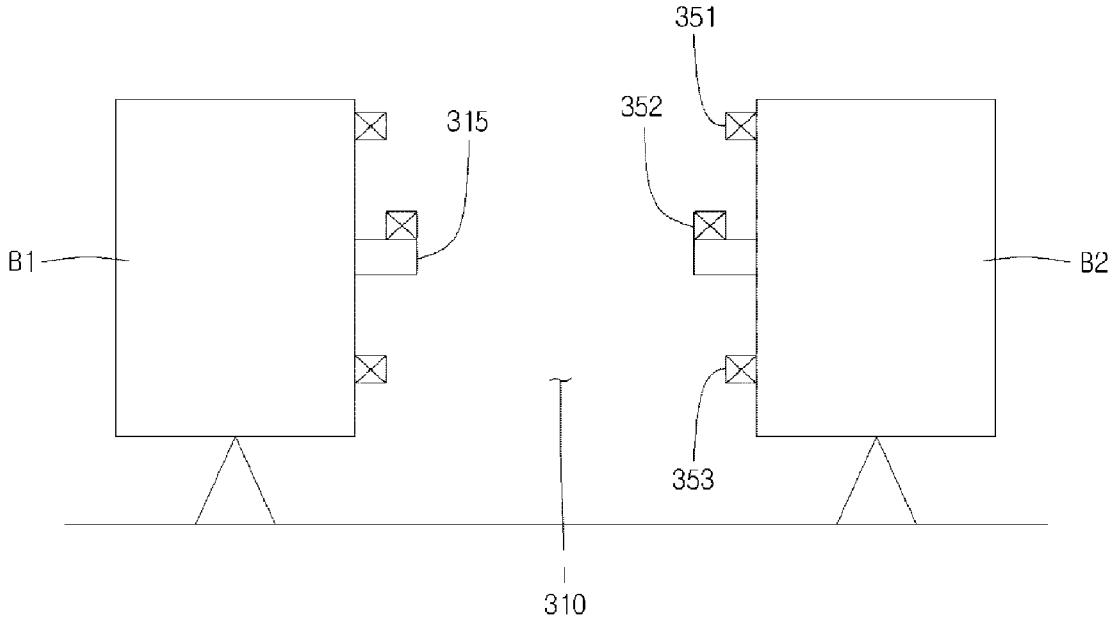
FIGS. 4 to 7 are views illustrating an installation method of a turret device according to the embodiment of the present invention.

Referring to FIG. 4, a first base block B1 and a second base block B2 that form the guide groove 310 are arranged to be separated from each other. A space between the first base block B1 and the second base block B2 are opened in the vertical direction. The space between the first base block B1 and the second base block B2 forms an inner space of the guide groove 310, and mutually facing side surfaces of the first base block B1 and the second base block B2 form a side surface of the guide groove 310. The first bearing 351, the second bearing 352, and the third bearing 353 are installed on the mutually facing surfaces of the first base block B1 and the second base block B2. The support unit 315 for supporting the second bearing 352 is formed on the mutually facing surfaces of the first base block B1 and the second base block B2.

Figure 5:
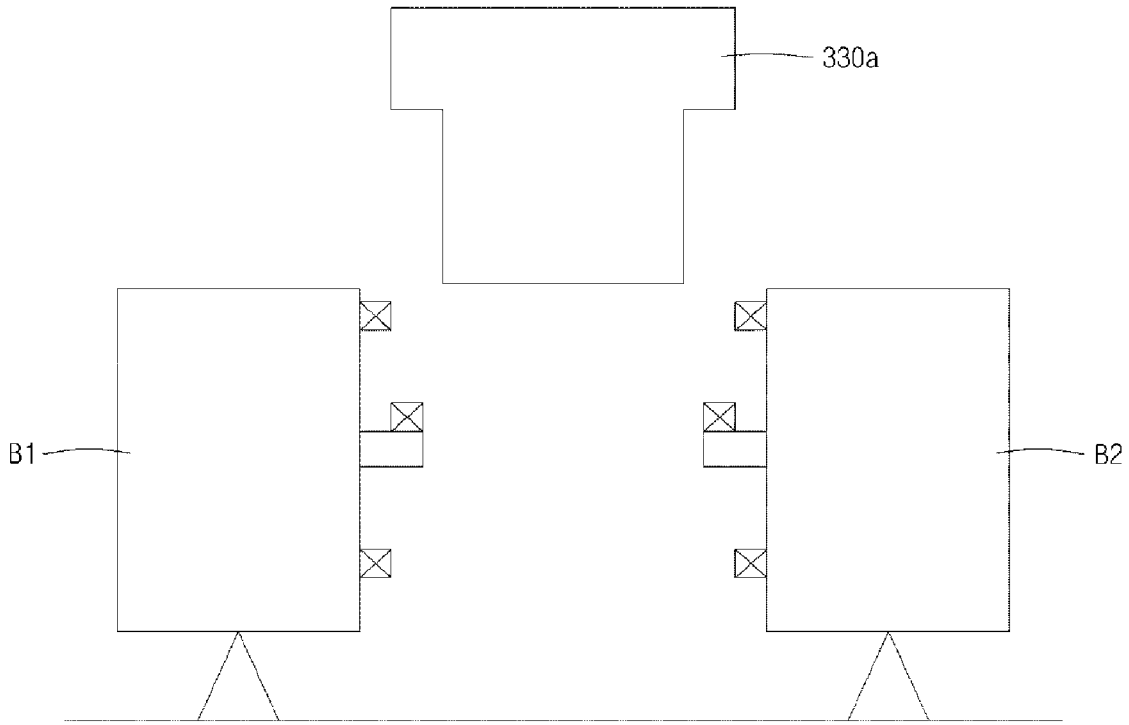
Figure 6:
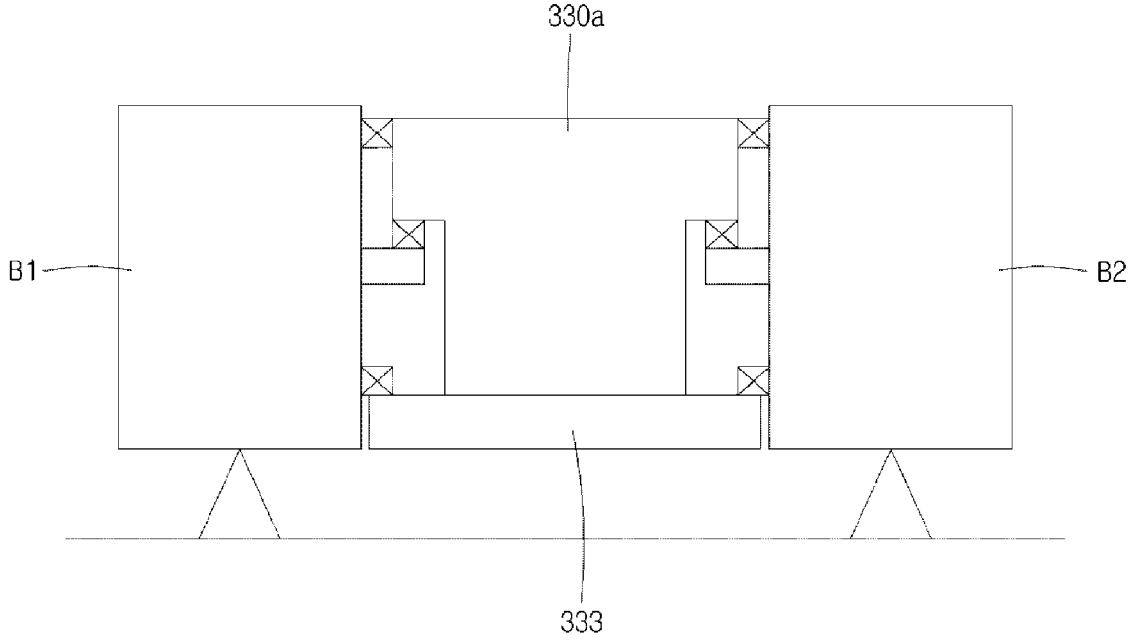

After that, as shown in FIG. 5, a turret body 330*a* in which the upper horizontal unit 331 (see FIG. 3) and the vertical connecting unit 335 (see FIG. 3) of the turret 330 (see FIG. 3) are integrally manufactured is lowered into a space between the first base block B1 and the second base block B2 to be inserted into the space.

After that, as shown in FIG. 5, the lower horizontal unit 333 of the turret 330 (see FIG. 3) is bolted and coupled to a lower end part of the turret body 330*a* inserted into the space between the first base block B1 and the second base block B2.

Figure 7:
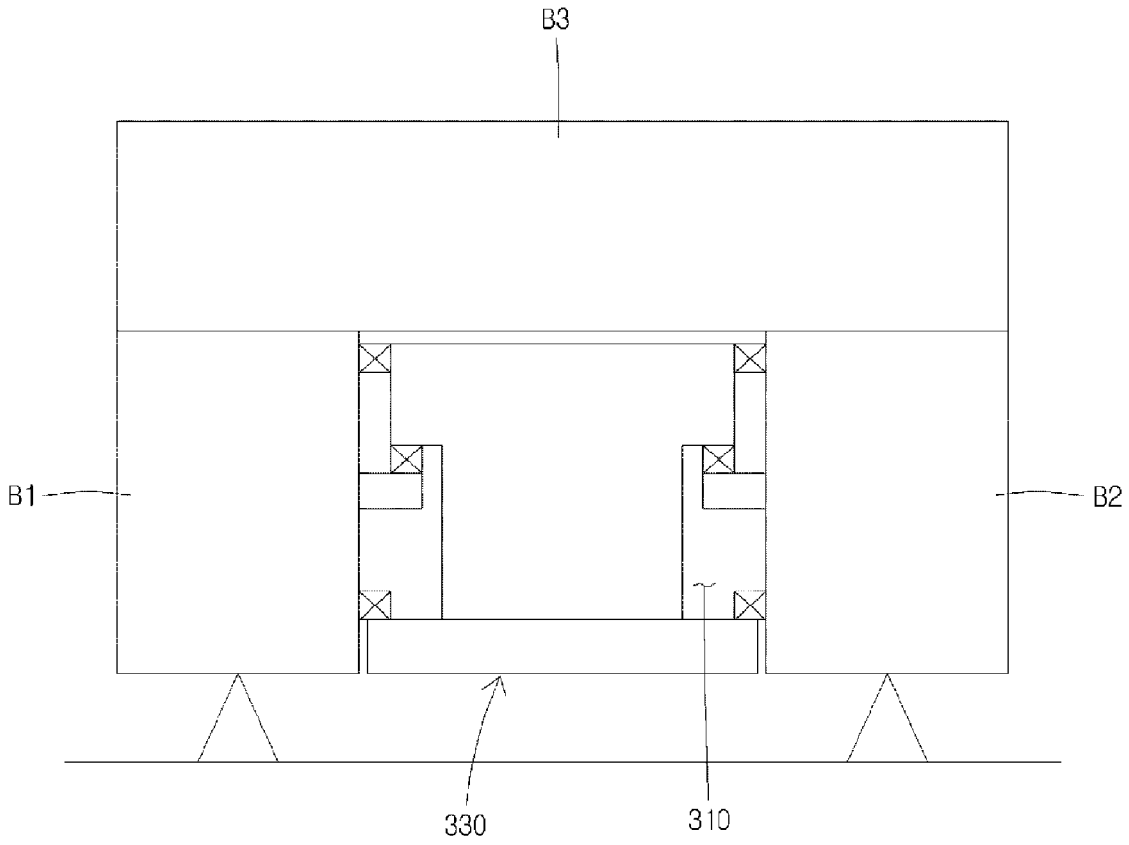

After that, as shown in FIG. 7, a cover block B3 covers upper surfaces of the first base block B1 and the second base block B2. In this case, an upper open part of a space between the first base block B1 and the second base block B2 is closed by the cover block B3, and the turret 330 is rotatably installed in the guide groove 310.

Figure 8:
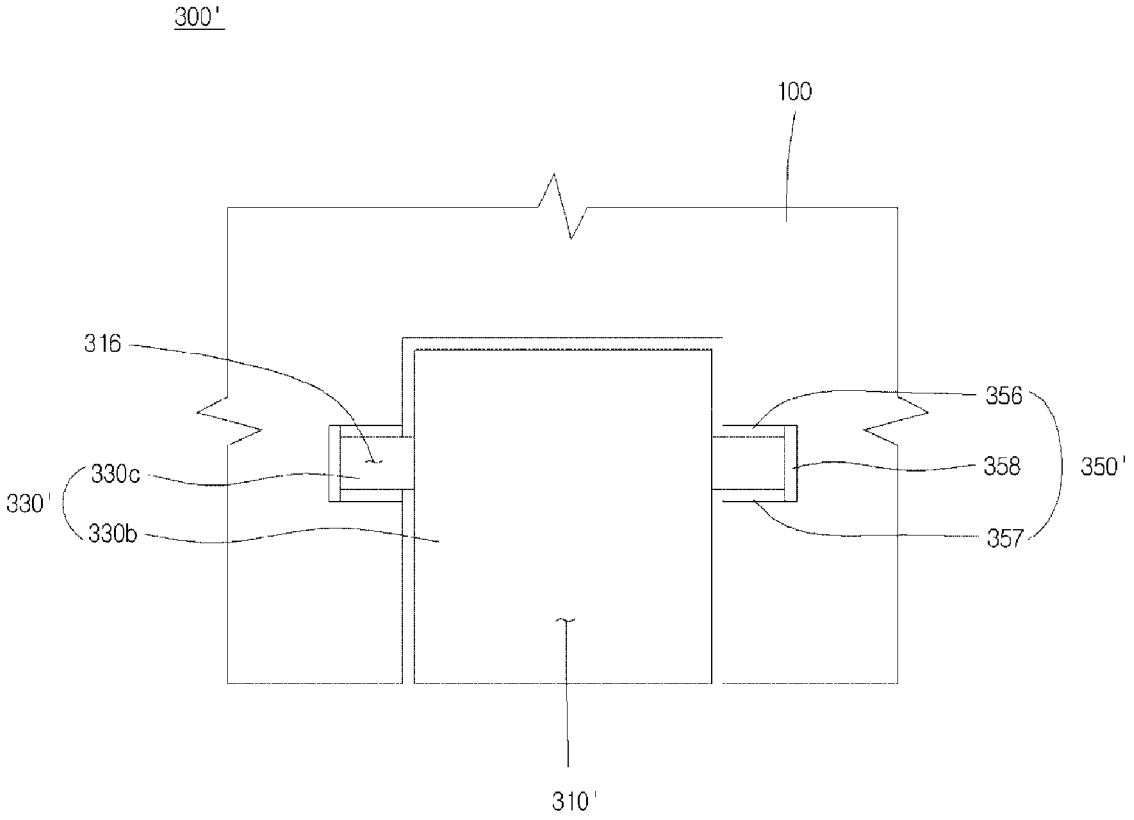
FIG. 8 is a view illustrating a mooring system according to another embodiment of the present invention.

FIG. 8 is a view illustrating the mooring system according to another embodiment of the present invention. Referring to FIG. 8, a mooring system 300' according to the embodiment of the present invention includes a guide groove 310', a turret 330', a bearing 350', a mooring cable (not shown), and an anchor (not shown).

The guide groove 310' is formed on a bottom surface of the hull 100. The guide groove 310' has a circular shape that uses the center P1 of a moon pool as a center thereof. The guide groove 310' is formed to surround a bottom inlet of the moon pool.

The turret 330' is inserted into the guide groove 310'. The turret 330' has a ring shape. The turret 330' is inserted into the guide groove 310'and rotates. The bearing 350' is interposed between the turret 330' and the guide groove 310'. The bearing 350' is provided to allow relative rotation with respect to the guide groove 310' of the turret 330'.

The turret 330' includes a turret body 330*b* and an extension member 330*c*. The turret body 330*b* has a ring shape. The turret body 330*b* may be determined to correspond to a shape of a cross-section of the guide groove 310'. The extension member 330*c* is extended from the turret body 330*b* in a lateral direction. The extension member 330*c* is slidably inserted into a sliding groove 316 surrounding an upper surface, a lower surface, and a side surface of the extension member 330*c*.

The sliding groove 316 is formed on a side surface of the guide groove 310'.

Or, although not shown, the sliding groove 316 may be provided by a support bracket installed on the side surface of the guide groove 310'.

The bearing 350' includes first bearing pads 356 and 357 and a second bearing pad 358. The first bearing pads 356 and 357 support an upper surface and a lower surface of the extension member 330*c*. The second bearing pad 358 supports a side surface of the extension member 330*c*. The first bearing pads 356 and 357 are coupled to a ceiling surface and a floor surface of the sliding groove 316, and the second bearing pad 358 is coupled to a side surface of the sliding groove 316.

As described above, embodiments of the present invention are described, but the present invention can be variously changed and modified from the description by a person skilled in the art to which the present invention pertains by the addition, modification, and removal of components without departing from the spirit of the present invention as defined by the following claims, and the changes and modifications are included within the intended scope of the present invention.

(Description of symbol)

| | |
|---|---|
| 10: DRILL SHIP | 100: HULL |
| 110: MOON POOL | 120: UPPER DECK |
| 130: AZIMUTH THRUSTER | 210: SUPPORT |
| 220: DRILL FLOOR | 230: DERRICK |
| 250: RISER | 300: TURRET DEVICE |
| 310: GUIDE GROOVE | 330: TURRET |
| 331: UPPER HORIZONTAL UNIT | |
| 333: LOWER HORIZONTAL UNIT | |
| 335: VERTICAL CONNECTING UNIT | 350: BEARING |
| 351: FIRST BEARING | 352: SECOND BEARING |
| 353: THIRD BEARING | 360: MOORING CABLE |
| 370: ANCHOR | |

The invention claimed is:

1. A mooring system of a drill ship having a moon pool formed in a hull, the mooring system, comprising:

a circular guide groove formed on a bottom surface of the hull and configured to use a center of the moon pool as a center thereof;

a turret having a ring shape and inserted into the guide groove to rotate; and a bearing interposed between the turret and the guide groove to rotate with respect to the guide groove of the turret, wherein the turret includes a turret body and an extension member extended from the turret body in a lateral direction, and the bearing includes: a first bearing pad configured to support an upper surface and a lower surface of the extension member; and a second bearing pad configured to support a side surface of the extension member.

2. A drill ship, comprising the mooring system according to claim 1.

* * * * *